US006561386B1

(12) United States Patent
Martens

(10) Patent No.: US 6,561,386 B1
(45) Date of Patent: May 13, 2003

(54) BALL CHECK VALVE ASSEMBLY

(75) Inventor: Matthew P. Martens, Chicago, IL (US)

(73) Assignee: Juice Tyme, Chicago, IL (US)

( * ) Notice: Subject to any disclaimer, the term of this patent is extended or adjusted under 35 U.S.C. 154(b) by 0 days.

(21) Appl. No.: 10/035,265

(22) Filed: Jan. 3, 2002

(51) Int. Cl.[7] ..... B65D 35/56
(52) U.S. Cl. ..... 222/105; 222/518; 222/570
(58) Field of Search ..... 222/92, 95, 105, 222/386.5, 518, 567, 570

(56) References Cited

U.S. PATENT DOCUMENTS 4,515,294 A * 5/1985 Udall ..... 222/105
4,865,233 A * 9/1989 Kain ..... 222/570
5,062,552 A * 11/1991 Heubel ..... 222/570
5,071,042 A * 12/1991 Esposito ..... 222/570
5,156,300 A * 10/1992 Spahni et al. ..... 222/105
5,390,814 A * 2/1995 Christine et al. ..... 222/105
5,556,005 A * 9/1996 Banks ..... 222/96

* cited by examiner

*Primary Examiner*—Joseph A. Kaufman
(74) *Attorney, Agent, or Firm*—Basil E. Demeur; Alan Samlan; David J. Hurley

(57) ABSTRACT

A bag and box liquid container assembly having an exit port formed with the bag and extending outwardly from the box, including a ball check valve assembly, the ball check valve assembly being adapted to be press-fitted onto a fluid tight sealing engagement with the exit port of the bag.

8 Claims, 3 Drawing Sheets

BALL CHECK VALVE ASSEMBLY

FIELD OF INVENTION

The present invention relates to an improvement in a valve assembly for use in connection with a bag in box type liquid container. The improvement consists of providing a spring loaded ball check valve assembly for use with a bag in box container intended to carry a liquid such as juice or other fluids therein.

BACKGROUND OF THE INVENTION

The art field with respect to the bag in box type fluid containing containers is well established. Such containers are usually formed by a bag created from a film material which is intended to carry a liquid therein, with the bag then being fully enclosed by a corrugated box. The bag is produced with a fluid exit opening to which is scaled an exit port sealingly engaged to the fluid exit opening. The method of securing the exit port to the fluid exit opening is usually dependent upon the material of which the bag is produced, and certainly includes such procedures as heat sealing, adhesive sealing, and the like. The enveloping box is provided with an opening which is in registry with the exit port of the bag such that the bag can be contained within the corrugated box and have the exit port extending outwardly from the corrugated box. In many applications, it is intended that the box having the bag contained therein with the fluid is installed in a device which has a valve assembly of some type such that once the box is installed in the assembly, the valve may be alternately opened and closed in order to permit fluid to exit from the bag for consumption purposes.

The advantage that such containers have over other older prior art containers is the fact that the fluid contained within the bag will stay fresher for much longer periods of time and therefore from the standpoint of shelf life, the product has an extended shelf life. Furthermore, such assemblies do not require that airholes be included in the container in order to permit the fluid to flow and exit from the container into the consumer's vessel.

Typically, such bag in box containers have been used to contain juice concentrate which are prepared with preservatives. Hence, the contents of the container is purely liquid in format, and does not contain any juice pulp with the fluid. Hence, in such applications, the exit port required for the bag in box container is simply a press-fitted port which has exit openings therein sized in order to allow the fluid from the container to be drawn therefrom in the appropriate application. The present state of the art therefore permits a juice concentrate to be vended from a bag in box container. Such containers are presently not able to vend fresh juices which contain pulp because the exit ports are not designed to allow pulp to flow through the exit ports without the pulp ultimately plugging the exit ports and therefore stopping fluid flow.

It is important to know that the equipment which has been created in order to produce the bag in box assemblies with exit ports on a mass production basis have been designed to accommodate the press-fitted exit ports which exist with respect to the present art. The accompanying drawings and descriptions will adequately describe the present state of the art with respect to such exit ports and the inter-relationship with the bag in box assembly.

Another format of these types of containers which is presently available in the art are plastic containers which carry a liquid therein and are intended for the mass market and which are especially created for juice machines. Juice machines are usually designed to accommodate a plurality of plastic container cartridges which are positioned within the machine in a vertical positioning so that the machine is designed to dispense any one of a number of juices. It is well-known that juice bars and other similar types of establishments contain juice machines which are designed to dispense a plurality of juices from each machine including orange juice, pineapple juice, grape juice and the like. In such applications, the plastic containers are designed to be filled with a juice, then frozen until the same are ordered and delivered to the end destination. The containers are delivered in a frozen state, and therefore require the recipient of the container to maintain the frozen state of the container until they are ready for use. The container cannot be used in the juice machine unless and until the container is left to atmosphere in order to cause a thawing of the frozen juice whereupon the container may then be placed into the juice machine with the exit port positioned in an appropriate valve assembly so that the juice from the container may be dispensed when the valve is opened.

The one principal advantage that the containers containing the frozen juices have over the bag in box containers is the fact that any juices contained in such plastic containers may have frozen juices including the pulp. Various segments of the public have come to believe that juices containing the pulp of the juice is a healthier product for ingestion, and therefore there appears to be some desire that vended juices contain the pulp as well as the juice. Hence, typically such plastic containers include an exit port having a screw thread thereon, and a ball check valve assembly screw threaded onto the exit port. Ball check valve assembly will operate in conjunction with a juice machine such that when a handle is pulled or the valve otherwise open, the ball is urgingly removed from the opening and a free path is opened to the interior of the container. Hence, juice including the pulp may flow freely through the ball check valve once it is opened when dispensing the juice from within the container. The juice flow with pulp will continue until the valve is placed into the closed position.

It will therefore be appreciated that while such plastic containers have the advantage of permitting juice with pulp to be contained therein and vended therefrom, the disadvantage of such containers is the primary fact that such containers must be frozen prior to delivery to the end destination, and must be kept in a frozen state until they are ready for use. This, therefore, necessarily requires that the recipient of the containers, or the proprietor of the juice bar, have sufficient freezer space available to accommodate the storing of a plurality of such plastic cartridges until the juice is ready to be installed in the machine and vended. It will therefore be appreciated that the recipients of the containers are required to expend substantial amounts of money in terms of freezer space, square footage of the establishment in order to accommodate the use of a juice machine which vends fresh juice with pulp.

It has been determined that it would be advisable to be able to present a bag in box container for vending a juice with the pulp component included therein, but that that has not become possible for the reason that the exit ports associated with bag in box containers will not allow the passage of the pulp therefrom without plugging the valving incident to the use of the container. Furthermore, it has not been possible to change the valving fitment of the bag in box container due primarily to the manner in which the bag in box assemblies are constructed and the method of manufacture thereof. As was previously indicated, the bag is produced with a fluid exit opening to which is sealed an exit port employing either heat sealing, adhesive sealing or the like. The exit port accommodates the press fitted exit port valve which has exit openings sized in order to permit the juice concentrate to flow therethrough. The manufacturing machines designed to create such bag in box assemblies are therefore presently adapted for press fitting the exit port onto the collar which is sealing engaged to the bag. For this reason, ball check valve assemblies have not been deemed appropriate to be used in connection with bag in box containers.

It has been determined, however, that it would be advantageous to provide a bag in box assembly having a ball check valve which would then afford the opportunity to vend juice with pulp from a bag in box assembly.

It must also be understood that incident to the manufacture and filling of such bag in box assemblies, the juice which is filled into the bag includes preservatives which therefore give the product a far greater extended shelf life than the plastic containers which contain frozen juice. Since the bag in box containers do not require an atmospheric opening, but rather, operate on a gravity flow when dispensing from the bag, the product quality will not deteriorate upon an extended shelf life situation. Hence, if one were able to maintain the same manufacturing process of filling a bag in box assembly with juice, but including the pulp, and adapt a ball check valve assembly to be installed onto the container, using the present equipment, one would have a product with extended shelf life while still avoiding the requirement of freezing the product prior to use. Furthermore, by sizing the developing box to the same configuration as the plastic container, such assemblies may be used in current juice machines without any adaptations.

It is therefore intended to provide the presently existing bag in box assemblies with a ball check valve assembly which may be press fitted to the container utilizing existing equipment, and thereby permits the bag in box assembly to be filled with a juice including the pulp from the juice, and allow the same to be dispensed therefrom without clogging the exit valve. Such a device will also achieve all of the advantages of the present fresh frozen juices, but eliminates the need for any freezing requirements until the product is ready for use. The current bag in box assembly may therefore be delivered to the end destination and stored normal atmospheric conditions until it is ready for use thereby eliminating the need for freezer space and the concomitant weight until the product has thawed in order for it to be useful in the juice machines.

PRIOR PATENTED ART

The prior patented art clearly shows a variety of types of dispensing devices and valving assemblies which represent the current status of the art. A typical type cartridge dispenser and bag in box cartridge is well known in connection with liquid soap dispensers. This is shown in U.S. Pat. No. 4,895,276 wherein the construction of a box usually formed of corrugation contains a bag therein, the bag containing the soap fluid. The bag is provided with an exit port and intended to be installed into a dispensing machine which, as illustrated in U.S. Pat. No. 4,895,276, is in the nature of a plastic tube which may be alternately opened and closed by a bracket in order to permit soap to flow therefrom. The purpose of showing U.S. Pat. No. 4,895,276, is to clearly illustrate the art with respect to bag in box containers.

Another variation of a bag in box type fluid containing dispenser cartridge is shown in U.S. Pat. No. 5,156,300. The purpose of the invention as depicted therein is to provide a means for preventing substantial axial movement of the bag in the direction of the discharge orifice in order to insure that all of the fluid within the bag will be appropriately dispensed.

In U.S. Pat. No. 5,390,814, there is shown a bag in box container for containing a pharmaceutical fluid. The invention as depicted therein is intended to provide a fitment which may be interposed between the plastic liquid containing pouch with the box, and the valve so that the valve may be rigidly secured to the pouch. As indicated therein, the fitment is constructed from a rigid plastic which is thermally welded to the pouch by a sealing sleeve and otherwise then affixed to the valve so that the valve is securely fitted to the pouch. As indicated therein, the valve permits fluid to be extracted from the pouch with the fitment extending outwardly from the box through an aperture appropriately provided. The description indicates that a number of valve structures may be used in connection with the subject pouch, including a flap valve, or a ball check valve. However, it is clear that the fluid intended to be carried in the pouch as described in the aforesaid patent is a pharmaceutical, and does not have the same difficulties and problems associated with it as does a fresh juice concentrate fluid which contains pulp. Furthermore, ball check valves are known when used in conjunction with certain types of containers as was previously described in connection with molded plastic containers intended to carry a juice fluid and intended to be used in a juice dispensing machine. Since it is now deemed desirable by the public to be able to ingest the pulp as well as the fruit juice, it is necessary to provide a bag in box assembly which includes a valve accommodated to dispense both the pulp as well as the juice and still be manufactured in accordance with current manufacturing procedures and with current manufacturing equipment.

OBJECTS AND ADVANTAGES

It is the primary object of the present invention to provide a bag in box liquid containing assembly which includes an improved ball check valve assembly fitting which permits a juice including the pulp contained in the juice to be efficiently dispensed from the bag enveloped in the box.

In conjunction with the foregoing object, it is a further object of the present invention to provide a ball check valve assembly which may be secured to an existing type bag in box assembly which provides an exit port intended to receive a press-fitted valve assembly thereon.

A further object of the present invention is to provide a fresh juice concentrate containing bag in box assembly which accommodates a ball check valve assembly to be press-fitted thereto, and which will be accommodated and will operate in conjunction with existing juice dispensing machinery.

Further features of the invention pertain to the particular arrangement of the parts and elements whereby the above outlined objects and advantages will be attained. The invention will better be understood by reference to the following specification taken in conjunction with the following drawings.

BRIEF DESCRIPTION OF DRAWINGS

FIG. 1 is inserted for dispensing juice therefrom.

DETAILED DESCRIPTION OF DRAWINGS

Figure 1:
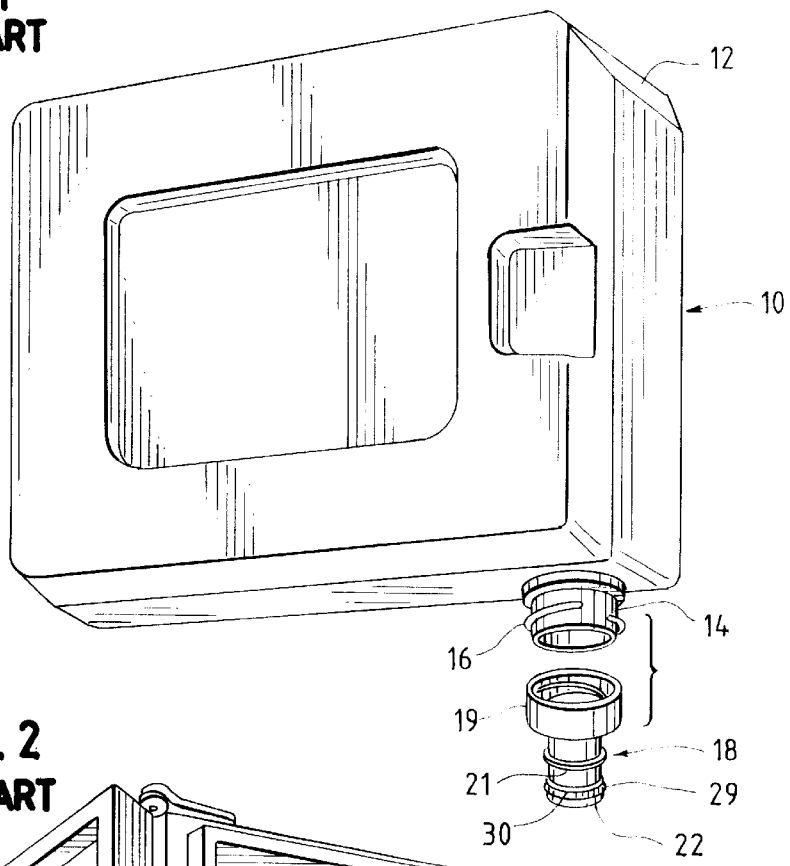
FIG. 1 PRIOR ART
FIG. 1 is a plan view showing a prior art type blow molded plastic fluid container of the type presently in use and including a screw threaded ball check valve assembly associated therewith.
Figure 5:
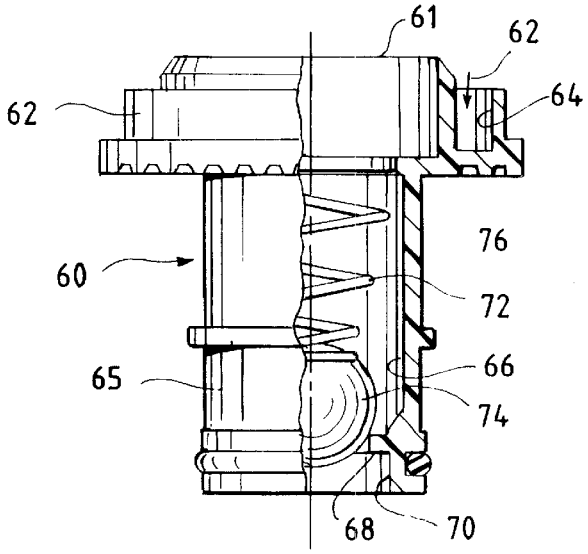
FIG. 5 is a elevational view, partly in cross section showing the ball check valve assembly of the present invention.

FIG. 1 illustrates the typical presently existing prior art type cartridge particularly suited for the distribution of fruit juice. As depicted therein, the cartridge 10 is basically rectangular in configuration and includes an airhole 12 located adjacent the top portion of the cartridge 10. The opposed end of the cartridge 10 includes a porthole 14 which is usually formed integrally with the cartridge 10. The porthole 14 is constructed with a plurality of screw threads 16 formed along the outer surface thereof and accommodates a ball check valve 18 to be screw threadedly mounted on the porthole 14. The ball check valve assembly 18 includes a cap 19, a nozzle portion 21 extending downwardly therefrom, terminating at an exit port 22. As shown in FIG. 5, the nozzle contains a coil spring 24 which is interposed between the ball 26, and a mounting rim 28 formed internally of the nozzle 21.

Again with reference to FIG. 1, the exterior surface of the nozzle 21 includes a groove 29 which carries an O-ring 30 such that when the cartridge 10 is positioned in a juice machine and set into place, the exterior portion of the nozzle will fit into an appropriate dispensing channel formed in the dispensing machine as is well known in the art.

Figure 2:
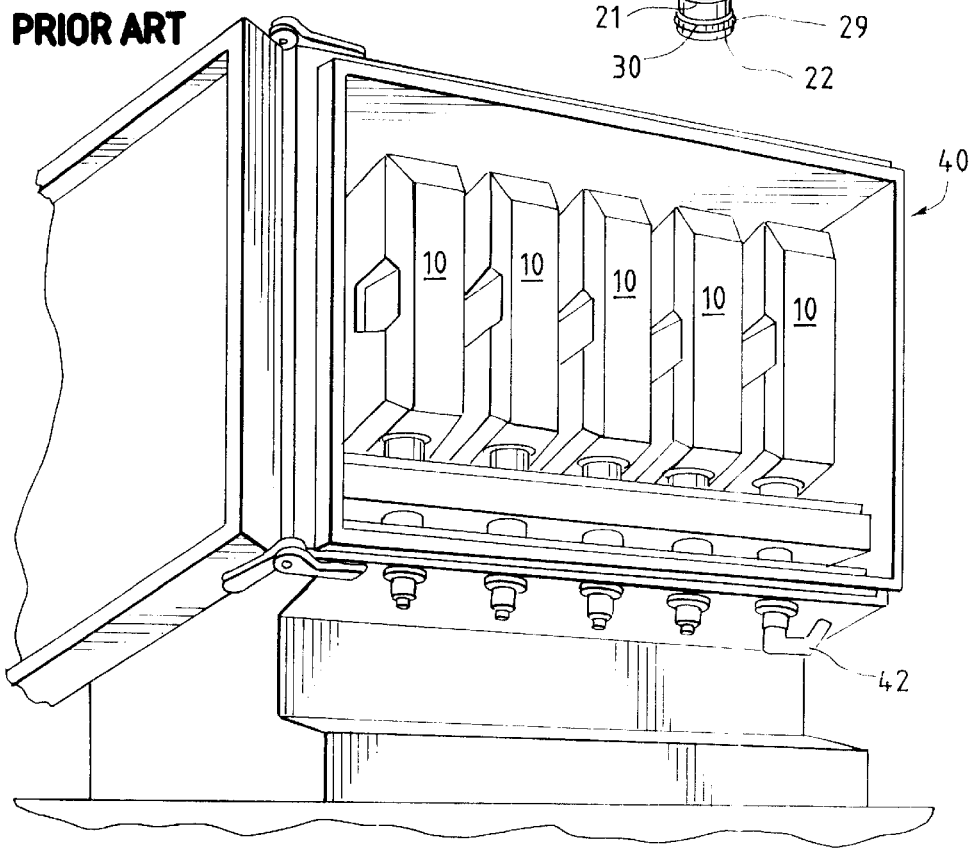
FIG. 2 PRIOR ART
FIG. 2 illustrates a typical juice dispensing machine into which a plastic container per

With reference to FIG. 2, a typical dispensing machine 40 is illustrated, and is shown to accommodate a plurality of cartridges 10 therein, each cartridge carrying a particular type of fruit juice. As is well known in the art, the dispensing machine 40 is provided with appropriate valve operating handles or levers 42 which, when depressed or pushed, will operate to open the ball valve of the nozzle 21 and allow fluid to flow therethrough.

Figure 3:
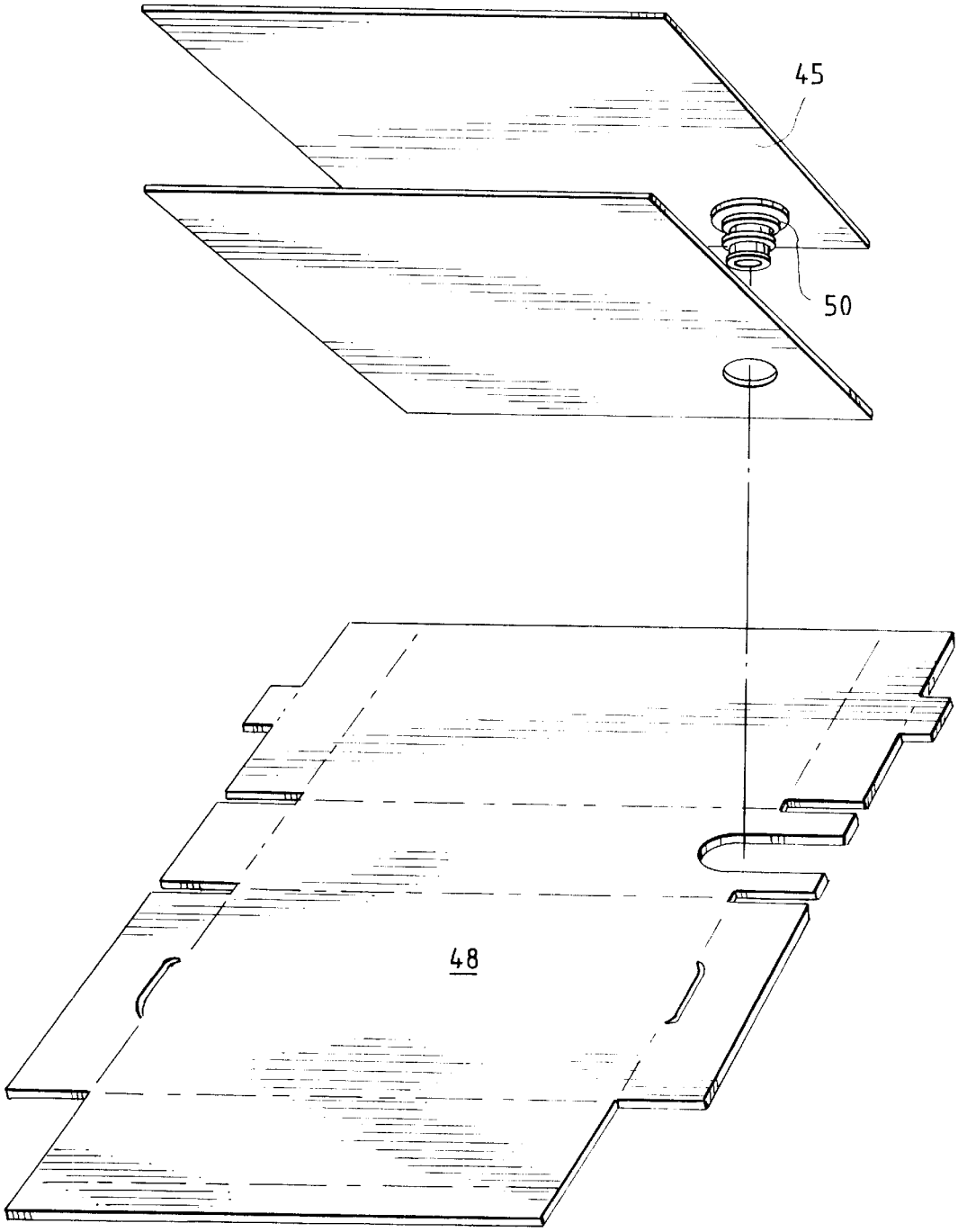
FIG. 3 is a plan view showing the construction of a bag in box assembly in the unassembled position, including the exit port of the bag, and a press fitted fluid port associated therewith.
Figure 4:
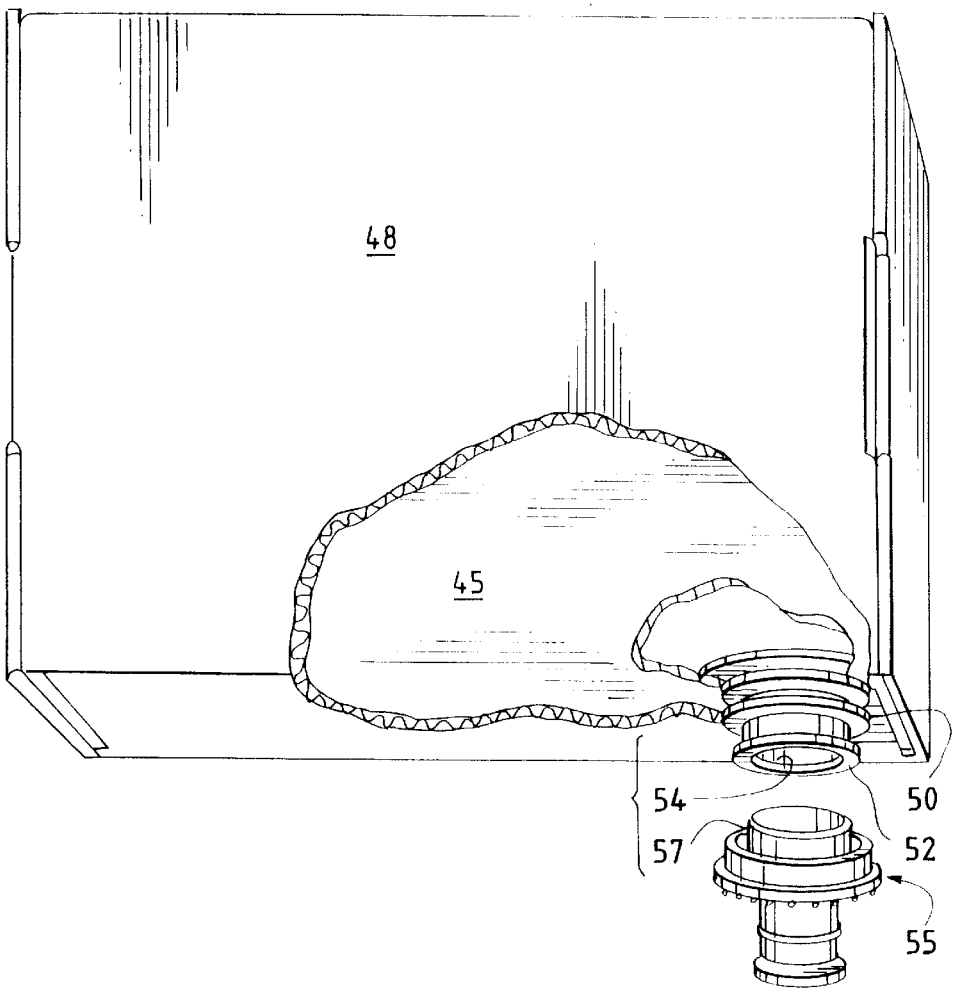
FIG. 4 shows a plan view, partly in cross section, of a bag in box assembly including an exit port associated with the bag, and a ball check valve assembly provided with a press fitting collar for fitment upon and securement to the exit port of the bag.

A bag in box assembly is depicted in FIG. 3. The bag in box assembly generally includes a poly bag 45 which may be formed of a plasticized material, or alternatively with a metallized material as is well known in the art. The poly bag 45 is enveloped within a corrugated container or box 48 such that the box forms the outer surface of the cartridge with the poly bag 45 contained therein. The poly bag is adapted to contain the fruit juice or other liquid as is known in the art. The poly bag further includes an exit port 50 which is particularly shown in FIG. 4. The exit port 50 generally is formed from a plasticized material such as polyethylene or polypropylene, and is designed to have a plurality of exit apertures through which the juice flows. As is well known in the art, such types of dispensers of the type depicted in FIG. 4 may contain a fruit juice, but the exit ports are designed such that only the juice may flow therethrough leaving the pulp behind. Hence, even when one provides a fresh squeezed orange juice type product, and packages it in a poly bag assembly, the device will only dispense the juice with the exit port filtering out the pulp, or operating until it becomes clogged by the pulp.

The assembly is completed by means of a press-fitted fitting 55 which is press-fitted over the exit port 50 in order to complete the assembly. The fitting 55 is provided with a U-shaped channel 57 which is designed to lockingly press fit over the rim 52 of the exit port 50.

As shown in FIG. 5, the improved ball check valve assembly of the present invention is illustrated. A ball check valve assembly is generally illustrated by the numeral 60. The assembly 60 includes an upper end 61 which is formed into a U-shaped channel 62 which is circumferential in configuration. The U-shaped channel 62 includes a lock ring 64 which is adapted to lock onto a lock flange 54 provided along the inner surface of the exit port 50.

The ball check valve assembly 60 is further provided with an elongate nozzle 65 which is basically tubular in configuration and therefore includes an open channel 66 extending from the upper end thereof to the lower end thereof. The lower end of the nozzle 65 is provided with an internally positioned valve seat rim 68 and terminates in an exit aperture 70.

The channel 66 of the nozzle 65 is provided with coil spring 72 which is interposed between the ball 74 of the ball check valve assembly, and a mounting flange 76 formed along the inner portion of the nozzle 65 adjacent the upper end thereof. It will be appreciated that when pressure is applied upwardly against the ball 74, the spring will be depressed and thereby open the channel 66 to allow fluid from the poly bag 45 to flow therethrough.

It will be appreciated that with the presently existing high speed equipment for producing the bag in box assemblies, which includes machinery intended to mount the exit port to the poly bag, and then apply the fitting over the exit port, the ball check valve assembly 60 of the present invention can be substituted for the press fitted fitting heretofore utilized with prior art devices. It will therefore be appreciated that no adaptations have to be made in connection with the manufacturing process presently used for creating the bag in box assemblies.

It will be appreciated from the above description that the ball check valve assembly 60 as described hereinabove is particularly suited for use in connection with the high speed manufacturing equipment presently used to create the bag in box assemblies as described. The ball check valve assembly 60 may be substituted for the press-fitted fitting 55 and can therefore be installed on the exit port 50 to complete the bag in box assembly.

It will therefore be appreciated that the bag in box assembly including the ball check valve assembly 60 of the present invention can now be used in juice dispensing machines and will operate to dispense not only the fluid fruit juice, but any fruit juice which also contains the fruit pulp such as orange juice. Furthermore, the bag in box assembly may be constructed and sized accordingly so that it will fit existing juice dispensing machines, and thereby provide the operators of such machines with the ability to purchase juice concentrates including the pulp, in the bag in box assembly which thereby eliminates the need to purchase such juices in plastic containers which are frozen. As previously indicated, when the operators are required to purchase the plastic cartridges with frozen juice therein, first, it is necessary that they provide freezer space in order to maintain the plastic cartridge with the juice contained therein in a frozen state until it is finally used. Secondly, it requires that the operator remove the plastic cartridge from the freezer prior to use and allow the product to thaw out before it may be used in the juice dispensing machine. This necessarily requires the use of freezer space, and a time lag between the removal from the freezer and the ability to use the product. The bag in box assembly on the other hand, now containing a ball check valve assembly, permits the juice concentrate product to be delivered to the user, and may simply be stored in a non-frozen environment until the product is used in a dispensing machine. As was previously indicated, the fact that the juice contained within the bag is not exposed to atmospheric conditions and includes juice preservative results in the fact that the product has a greatly extended shelf life and will not spoil or deteriorate until it is finally used in juice dispensing machines. Hence, the result and consequences of now providing a bag in box assembly with a ball check valve assembly has advantages which are many fold over the prior art type container.

While there has been described what is at present considered to be the preferred embodiments of the invention, it will be understood from the above description and accompanying drawings that various modifications may be made therein, and it is intended to cover in the appended claims all such obvious variations and modifications which may be developed.

What is claimed is:

1. A bag in box liquid container assembly forming a liquid containing cartridge of the type having an exit port integrally formed with the bag and extending outwardly from the enclosing box, the improvement comprising, a ball check valve assembly, said ball check valve assembly including an upper end and a lower end, said upper end formed by a circumferential U-shaped collar, said U-shaped collar adapted to be press-fitted onto a fluid tight sealing engagement with said exit port of said bag, a nozzle extending downwardly from said collar, said nozzle terminating at the lower end of said assembly and forming a valve port bordered by a rim, said nozzle containing a spring loaded ball valve therein with said spring positioned above said ball to urgingly force said ball against said rim of said nozzle and adapted to alternately open and close said valve port to allow fluid from said container to alternately flow and cease flow therefrom.

2. The bag in box container as set forth in claim 1 above, wherein said exit port of the bag is provided with a circumferential locking flange and said U-shaped collar is provided with locking means associated therewith to lock onto said locking flange and secure said ball check valve assembly to said container assembly.

3. The bag in box container assembly as set forth in claim 2 above, wherein said locking means on said U-shaped collar is formed by a lock ring adapted to matingly engage said locking flange to retain said ball check valve assembly onto said exit port.

4. The bag in box container assembly as set forth in claim 1 above, wherein said nozzle includes an outer surface, said outer surface provided with a circumferential groove adjacent the lower end thereof and said groove carrying an O-ring therein.

5. The bag in box container assembly as set forth in claim 1 above, wherein said nozzle is tubular in configuration providing an open channel from said upper end to said valve port at the lower end, and wherein said spring is a coil spring having an upper mounting end and a lower ball biasing end.

6. The bag in box container assembly as set forth in claim 5 above, wherein said nozzle includes a circumferential spring mounting ledge adjacent the upper end thereof and accommodates the mounting of the upper mounting end of said spring there against, and thereby biasingly urges said ball against said valve port into the normal closed positioned.

7. A bag in box liquid container assembly forming a liquid containing cartridge of the type having an exit port integrally formed with the bag and extending outwardly from the enclosing box, the improvement comprising, a ball check valve assembly, said ball check valve assembly including an upper end and a lower end, said upper end formed by a circumferential U-shaped collar, the exit port of the bag provided with a circumferential locking flange, said U-shaped collar of said ball check valve assembly provided with a locking ring adapted to matingly engage said locking flange on said exit port in order to retain said ball check valve assembly onto said exit port, a nozzle extending downwardly from said collar, said nozzle terminating at the lower end of said assembly and forming a valve port bordered by a rim, said nozzle of said ball check valve assembly being tubular in configuration and providing an open channel from the upper end to said valve port at the lower end, and having a spring contained within said tubular channel, said spring having an upper mounting end and a lower ball biasing end, a ball closure carried within said channel and being positioned within said channel by said lower ball biasing end of said spring and positioned immediately above said rim of said valve port, said spring being adapted to urgingly force said ball against said rim of said nozzle and adapted to alternately open and close said valve port to allow fluid from said container to alternately flow and cease flow depending upon the positioning of the ball with respect to the rim of the valve port.

8. The bag in box container assembly as set forth in claim 7 above, wherein said nozzle includes an outer surface, said outer surface provided with a circumferential groove adjacent the lower end thereof, said groove carrying an O-ring therein.

* * * * *